US011105115B1

(12) United States Patent
Terry

(10) Patent No.: US 11,105,115 B1
(45) Date of Patent: Aug. 31, 2021

(54) TWO PIECE FENCE LINE POST CAP

(71) Applicant: Milford Wayne Terry, Hazel Green, AL (US)

(72) Inventor: Milford Wayne Terry, Hazel Green, AL (US)

( * ) Notice: Subject to any disclaimer, the term of this patent is extended or adjusted under 35 U.S.C. 154(b) by 0 days.

(21) Appl. No.: 17/182,303

(22) Filed: Feb. 23, 2021

Related U.S. Application Data

(60) Provisional application No. 63/101,267, filed on Apr. 23, 2020.

(51) Int. Cl.
*E04H 17/14* (2006.01)
*E04H 17/00* (2006.01)

(52) U.S. Cl.
CPC ..... *E04H 17/1447* (2021.01); *E04H 17/006* (2021.01)

(58) Field of Classification Search
CPC . E04H 17/14; E04H 17/1413; E04H 17/1417; E04H 17/1421; E04H 17/1447; E04H 17/1482; E04H 17/20; E04H 17/22
See application file for complete search history.

(56) References Cited

U.S. PATENT DOCUMENTS 2,954,212 A * 9/1960 Cox ..... E04H 17/24 256/11
3,428,300 A * 2/1969 Sconzo ..... F16B 7/048 256/59
3,462,804 A * 8/1969 Renaudin ..... F16L 3/10 248/74.4
3,749,368 A * 7/1973 Miller ..... E04H 17/24 256/11
3,972,639 A * 8/1976 Lening ..... F16B 7/048 403/191
5,853,167 A * 12/1998 West ..... E04H 17/20 256/66
7,789,377 B2 * 9/2010 Gallea ..... E04H 17/20 256/65.02
2003/0160222 A1 * 8/2003 Steffes ..... E04H 17/1439 256/1

* cited by examiner

*Primary Examiner* — Daniel J Wiley
(74) *Attorney, Agent, or Firm* — The Rapacke Law Group, P.A.

(57) ABSTRACT

A two piece fence line post cap is disclosed, including a cap having a top component releasably engaged with a bottom component. The top component having a U-shape to retain a top rail of a fence between a top surface of the bottom component and the U-shaped top component. The bottom component is a cylindrical shape having an open end to receive the top rail.

5 Claims, 3 Drawing Sheets

TWO PIECE FENCE LINE POST CAP

CROSS-REFERENCE TO RELATED APPLICATIONS

The present application claims priority to U.S. Provisional Patent Application 63/101,267 filed on Apr. 23, 2020, entitled "LINE POST, TWO PIECE, EASY REPLACE TOP CAP FOR CHAIN LINK FENCING" the entire disclosure of which is incorporated by reference herein.

TECHNICAL FIELD

Embodiments of the invention relate to caps for fastening to the tops of fence posts and more specifically relate to two-piece fence line post caps for chain-link fencing.

BACKGROUND

Chain-link fence (also referred to as wire netting, wire-mesh fence, and chain-wire fence) is a type of woven fence usually made from galvanized or LLDPE-coated steel wire. The wires run vertically and are bent into a zig-zag pattern so that each bend hooks with the wire immediately on one side and opposing bends with the wire immediately on the other side. This production methods forms the characteristic diamond pattern seen in this style of fence. Installation of chain-link fence involves setting posts into the ground and attaching the fence to each post. The posts are often steel tubing but may be constructed of other materials. The posts set between terminal posts (posts at the end of the fence line) are called line posts.

Each post includes a cap (also called a loop cap) with the loop accepting the top rail of the fence. The cap is prone to breakage for a variety of reasons, requiring their replacement. In the current arts, single piece caps are most commonly used. However, single piece caps require the disassembly of several feet of the top rail of the fence in order to replace a broken one. This is because the top rails are fitted together end-to-end with the ends often not near the cap. This results in a tedious and time-consuming process when replacing a broken cap.

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments provided herein relate to a two piece fence line post cap is disclosed, including a cap having a top component releasably engaged with a bottom component. The top component having a U-shape to retain a top rail of a fence between a top surface of the bottom component and the U-shaped top component. The bottom component is a cylindrical shape having an open end to receive the top rail.

The two piece cap greatly reduces the time needed to replace a broke cap compared with the single piece caps used in the current arts. The two piece cap includes a top component releasably engaged with a bottom component. The top component is shaped in a general U-shape to accept a top rail of the fence while being enclosed by the attached bottom component.

In one aspect, the top component includes a left side and a right side each including a connector to releasably engage with complimentary receivers positioned on the bottom component.

In one aspect, the receiver includes a retainer disposed therein. The retainer interfaces with a clip component on the top component.

In one aspect, the retainer is disposed within a cavity of the bottom component.

In one aspect, a male hinge component and a female hinge component to pivotally engage the top component to the bottom component.

In one aspect, a securing means secures the top component to the bottom component.

In one aspect, the cap is constructed of aluminum or another sufficiently resilient material resistant to breakage or degradation.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
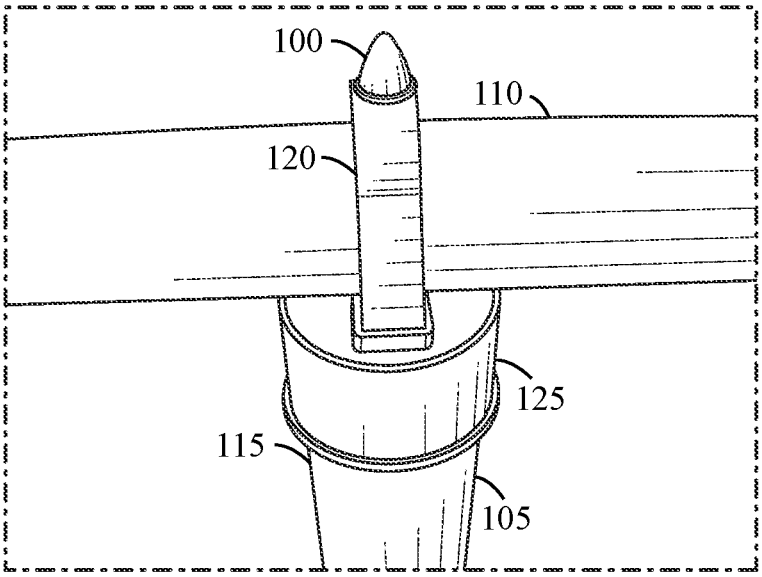
FIG. 1 illustrates a cutaway view of the two piece cap engaged with the line post and top rail of the chain-link fence, according to some embodiments.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a two piece cap for a chain-link fence post. The two piece cap greatly reduces the time needed to replace a broke cap compared with the single piece caps used in the current arts. The two piece cap includes a top component releasably engaged with a bottom component. The top component is shaped in a general U-shape to accept a top rail of the fence while being enclosed by the attached bottom component.

FIG. 1 illustrates a cutaway view of the two piece cap 100 engaged with the line post 105 and top rail 110 of a chain-link fence. The two piece cap 100 is dimensioned to attach to the top 115 of the line post 105 and receive the top rail 110 through the U-shaped top component 120. During installation, the top component 120 and bottom component 125 are separated to allow the installer to securably connect the bottom component 125 to the top 115 of the line post 105.

Figure 2:
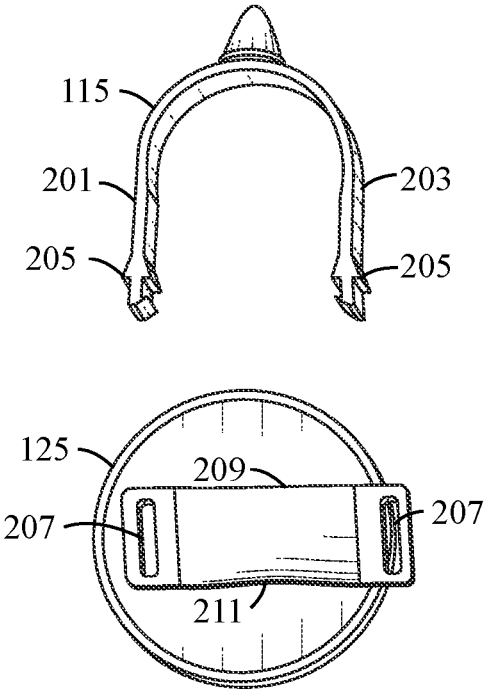
FIG. 2 illustrates an exploded view of the two piece cap including the top component and the bottom component, according to some embodiments.

FIG. 2 illustrates an exploded view of the two piece cap including the top component 120 and the bottom component 125. The top component 120 includes a left side 201 and a right side 203 each terminating in a connector 205. Each connector 205 releasably engage with the receivers 207 provided on an attachment means 209 on the top surface 211 of the bottom component 125. The connectors 205 may releasably engage via a clip mechanism to allow the user to apply pressure to the top of the top component 120 to connect the connectors 205 to the attachment means 209 during installation. During installation, the installer positions the top rail of the fence on the top surface 211 of the bottom component 125. The installer then connects the top component 120 to retain the top rail within the U-shaped top component 120.

Figure 3:
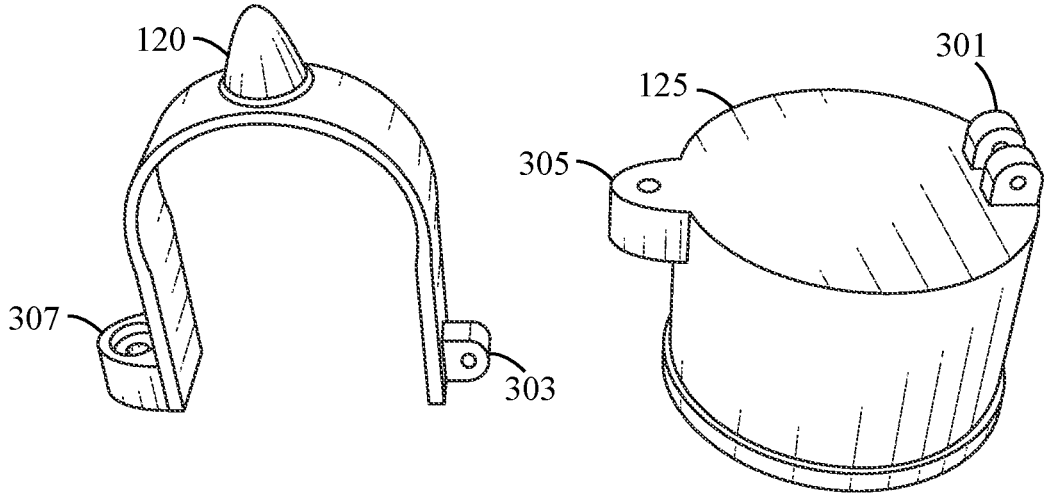
FIG. 3 illustrates a perspective view of the two piece cap wherein the top component and bottom component are separated, according to some embodiments.

FIG. 3 illustrates a perspective view of the two piece cap wherein the top component 120 and bottom component 125 are separated, such as when the cap has not yet been installed on the fence FIG. 3 illustrates an alternative embodiment wherein the attachment between the top component 120 and the bottom component 125 is a hinge having a female hinge component 301 and a male hinge component 303. A securing means 305,307 permits a bolt or screw to secure the top component 120 to the bottom component 125. In such, the installer can engage the hinge component 303 and position the top rail of the fence on top of the bottom component 125. The top component 120 may then pivot to close the top rail between the U-shaped top component and secure the securing means 305, 307 with a screw or bolt to complete the installation of the two-piece cap.

Figure 4:
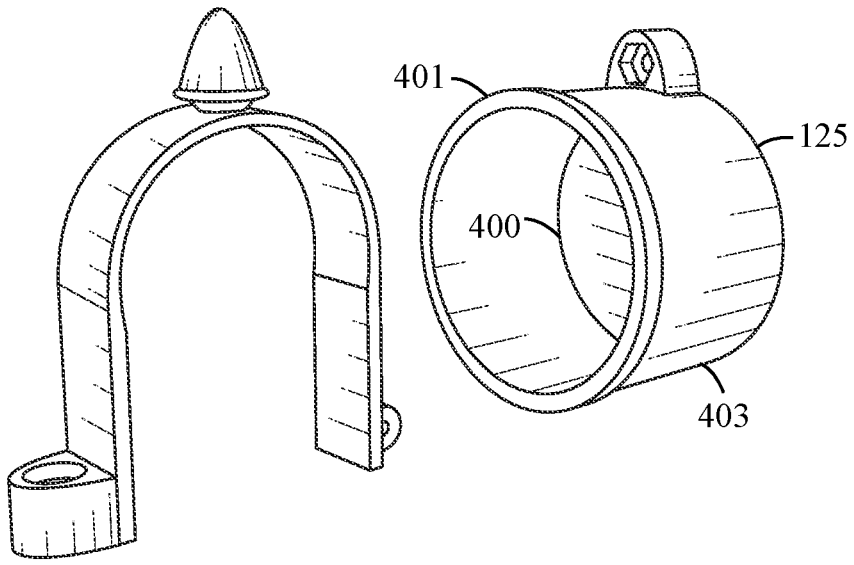
FIG. 4 illustrates a perspective view of the two piece cap wherein the top component and bottom component are separated, according to some embodiments.

FIG. 4 illustrates a perspective view of the two piece cap wherein the bottom side 400 of the bottom component 125 is shown. The bottom component 125 has a cylindrical shape having an open end 100 to receive the top of the line post. The top of the line post is inserted into the opening until the top surface of the line post contacts the bottom side 400 of the bottom component 125. Sidewall 403 has a sufficient height to ensure the bottom component is retained on the line pole.

Figure 5:
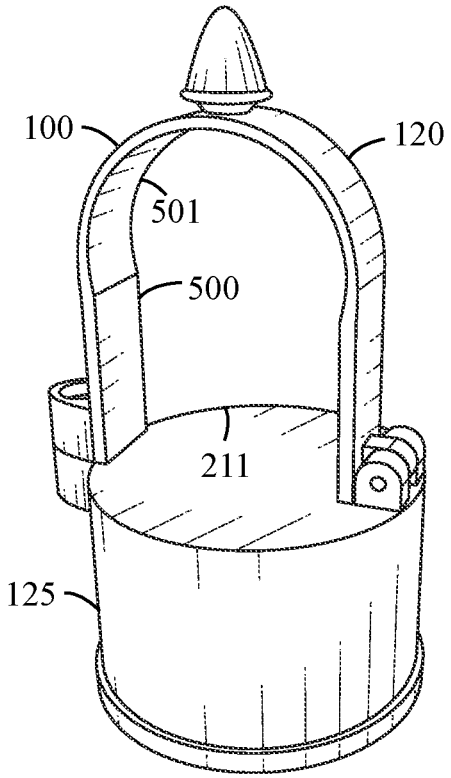
FIG. 5 illustrates a perspective view of the two piece cap, according to some embodiments.

FIG. 5 illustrates a perspective view of the two piece cap 100 wherein the top component 120 and bottom component 125 are attached. While FIG. 5 illustrates the hinge component embodiment shown in FIG. 3, the embodiment shown in FIG. 2 may also be applied without deterring from the embodiments described herein. Connecting the top component 120 and bottom component 125 allows the top rail of the fence to be retained within an opening 500 created by the inner surface 501 of the U-shaped top component 120 and the top surface 211 of the bottom component 125.

Figure 6:
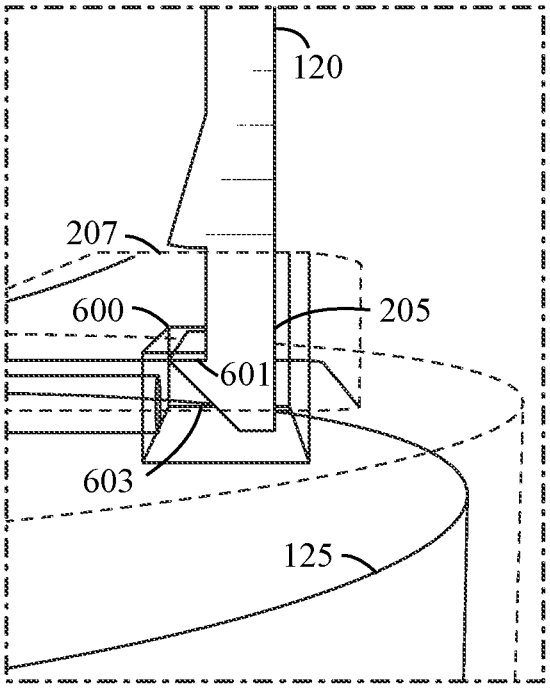
FIG. 6 illustrates a cutaway view of the attachment means to join the top component with the bottom component of the two piece cap, according to some embodiments.

FIG. 6 illustrates a cutaway view of the receiver 207 and connector 205 interface to attach the top component 120 to the bottom component 125. The receiver 207 includes a retainer 600 to retain a clip component 601 of the connector 205, thus retaining the at least a component of the connector 205 within a cavity 603. The connector 205 and receiver interface allows the connector to be releasably engaged with one another.

While the standard size line post is 1⅝ inches and the standard top rail is 1⅜ inches, one skilled in the arts will readily understand that the dimensions, shape, and configuration may be changed to accommodate various line post and top rail shapes and dimensions.

In some embodiments, the cap is constructed of aluminum. However, one skilled in the arts will readily understand that the cap may be constructed of similar metals, plastics, or other material having sufficient resilience and hardness to resist breakage and/or degradation.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A two piece fence line post cap, comprising:

a cap including a top component releasably engaged with a bottom component, the top component having a U-shape to retain a top rail of a fence between a top surface of the bottom component and the U-shaped top component, wherein the bottom component is a cylindrical shape having an open end to receive the line post; wherein the top component includes a left side and a right side each including a connector to releasably engage with complimentary receivers positioned on the bottom component; wherein each receiver includes a retainer disposed therein; and wherein each of the left side and the right side connectors has a profile including opposing positive and negative ramp sawtooth shapes.

2. The two piece fence line post cap of claim 1, wherein the retainer is disposed within a cavity of the bottom component.

3. The two piece fence line post cap of claim 2, wherein the cap is constructed of aluminum.

4. A two piece fence line post cap, comprising:

a cap including a top component releasably engaged with a bottom component, the top component having a U-shape to retain a top rail of a fence between a top surface of the bottom component and the U-shaped top component, wherein the bottom component is a cylindrical shape having an open end to receive the line post; wherein the bottom component includes a sidewall having a sufficient height to retain the line post; wherein the line post is inserted until a top of the line post contacts a bottom surface of the bottom component; wherein the top component includes a left side and a right side each including a connector to releasably engage with complimentary receivers positioned on the bottom component; and further comprising a male hinge component positioned on a proximal end of the U-shaped top component and a female hinge component positioned on a top surface of the bottom component to pivotally engage the top component to the bottom component; and further comprising an upper securing means positioned on a distal end of the U-shaped top component and a lower securing means positioned on a top surface of the bottom component wherein the upper and lower securing means are removably attached using a bolt or a screw to secure the top component to the bottom component.

5. The two piece fence line post cap of claim 4, wherein the cap is constructed of aluminum.

* * * * *